US006026951A

United States Patent [19]

Ovadia et al.

[11] Patent Number: 6,026,951

[45] Date of Patent: Feb. 22, 2000

[54] JEWELRY ROCKET

[75] Inventors: Joseph Ovadia, Little Falls; Pawel A. Kilar, Clifton, both of N.J.

[73] Assignee: Ovadia Corp., Little Falls, N.J.

[21] Appl. No.: 09/245,731

[22] Filed: Feb. 8, 1999

[51] Int. Cl.[7] ..... A45C 11/04

[52] U.S. Cl. ..... 206/6.1; 206/566; 211/85.2

[58] Field of Search ..... 206/6.1, 566; 211/85.2; 229/108.1, 110; 217/16; 220/4.29

[56] References Cited

U.S. PATENT DOCUMENTS

| | | | |
|---|---|---|---|
| 3,285,496 | 11/1966 | Barnhardt, Sr. et al. | 229/110 |
| 3,531,043 | 9/1970 | Carlsson et al. | 229/110 |
| 4,234,080 | 11/1980 | Gellert | 206/0.82 |
| 5,069,332 | 12/1991 | Williams et al. | 206/566 |
| 5,320,065 | 6/1994 | Leopold | 220/4.29 |
| 5,797,542 | 8/1998 | O'Connor | 229/110 |

*Primary Examiner*—Paul T. Sewell
*Assistant Examiner*—Luan K. Bui
*Attorney, Agent, or Firm*—Richard M. Goldberg

[57] ABSTRACT

A jewelry rocket includes a thin walled, plastic tower made from a blank folded into a closed configuration, the tower having an upper edge and a lower edge, with an opening in the upper edge, the blank including a thin, rigid plastic planar member having opposite side edges, an upper edge and a lower edge, a plurality of parallel living hinges arranged in the planar member to permit the planar member to be folded into the closed tower configuration, pairs of locking members formed at one side edge, single locking members formed at the other side edge for friction fitting within the pairs of locking members, trapezoidal flanges extending at right angles from an inner surface of the planar member at the upper edge and between the hinges thereon, a plurality of posts in the lower edge for engaging within holes of a support when the blank is formed into the tower, and a plurality of spaced apart tabs on an inner surface of the planar member for holding a reinforcing panel therein when the blank is formed into the tower; a jewelry holder including a plate for seating on the trapezoidal flanges and covering the opening thereat, downwardly extending flanges for friction fitting within the trapezoidal flanges to retain the plate on the trapezoidal flanges, and a holding arrangement for holding a jewelry item such that the jewelry item is viewable on the jewelry holder; and a leather wrapping secured around the tower.

15 Claims, 9 Drawing Sheets

JEWELRY ROCKET

BACKGROUND OF THE INVENTION

The present invention relates generally to jewelry display devices, and more particularly, is directed to a jewelry rocket for displaying rings, pendants and other jewelry items.

A jewelry rocket is a well known device for displaying a jewelry item, such as a ring, at a raised height above a support surface. The jewelry rocket generally has a tower configuration with a hexagonal, circular, octagonal, etc. cross-sectional shape, and with an upper surface which is angled. A jewelry holder is positioned on top of the jewelry rocket for holding the jewelry item at the angular orientation. The jewelry rocket also has a plurality of small protrusions at the lower edge thereof. Accordingly, a plurality of such jewelry rockets are generally positioned adjacent each other on a support having holes which receive the protrusions. Preferably, the jewelry rockets have different heights, in order to present a multi-tower configuration for displaying a plurality of jewelry items in a compact configuration.

However, each jewelry rocket is generally made from a solid piece of wood which can optionally be covered by leather or other material. Accordingly, each jewelry rocket is relatively expensive to manufacture and burdensome to produce.

Further, such jewelry rockets are relative heavy and bulky to transport, thereby further adding to the costs thereof.

OBJECTS AND SUMMARY OF THE INVENTION

Accordingly, it is an object of the present invention to provide a jewelry rocket that overcomes the problems with the aforementioned prior art.

It is another object of the present invention to provide a jewelry rocket that can easily be constructed from a molded blank.

It is still another object of the present invention to provide a jewelry rocket which has good structural integrity.

It is yet another object of the present invention to provide a jewelry rocket that is lightweight and easily transportable in a disassembled form.

It is a further object of the present invention to provide a jewelry rocket that is easy and economical to use and manufacture.

In accordance with an aspect of the present invention, a jewelry rocket includes a thin walled, plastic tower made from a blank folded into a closed configuration, the tower having an upper edge and a lower edge, with an opening in the upper edge; and a jewelry holder including a plate for seating on the upper edge and covering the opening thereat, and a holding arrangement for holding a jewelry item such that the jewelry item is viewable on the jewelry holder.

The tower includes a plurality of posts in the lower edge for engaging within holes of a support. The tower also includes a plurality of spaced apart tabs on an inner surface thereof for holding a reinforcing panel therein.

The blank includes hinges about which the blank is folded to form the tower. The lower edge of the blank includes at least one angled edge portion which forms the lower edge of the tower for causing the tower to extend from a support in an angular orientation other than a right angle. Further, the upper edge of the tower is preferably angled forwardly relative to a support surface on which the jewelry rocket is mounted.

The tower includes opposite edges of the blank which are in substantially abutting relation, and further includes fastening devices for securing the opposite edges together to retain the tower in an assembled condition. The fastening devices include at least one pair of locking members formed at one of the opposite edges, and at least one other locking member formed at the other of the opposite edges for friction fitting within the at least one pair of locking members. When the tower is so assembled together, a leather wrapping can be provided about the tower.

The tower also includes inwardly directed flanges at the upper edge, and the jewelry holder includes flanges extending downwardly from the plate for fitting within the inwardly directed flanges in order to retain the plate on the inwardly directed flanges.

The holding arrangement includes an opening in the plate, a holder extending down from the plate in surrounding relation to the opening, a foam material in the holder, the foam material including a first slit therein, and a covering on the plate in covering relation to the opening, the covering having a second slit in alignment with the first slit, such that a ring can be inserted through the first and second slits and be held by the foam material.

In accordance with another aspect of the present invention, a blank is provided for forming a tower of a jewelry rocket having a jewelry holder mounted on the tower, the blank including a thin, rigid plastic planar member having opposite side edges, an upper edge and a lower edge; a plurality of parallel hinges arranged in the planar member to permit the planar member to be folded into a closed configuration; and at least one fastening device for securing the opposite side edges together into a configuration of the tower.

Preferably, the at least one fastening device includes at least one pair of locking members formed at one of the opposite side edges; and at least one other locking member formed at the other of the opposite side edges for friction fitting within the at least one pair of locking members.

Also, the blank includes flanges extending at right angles from an inner surface of the planar member at the upper edge and between the hinges for engaging and holding the jewelry holder thereon. Preferably, the flanges having a substantially trapezoidal configuration. Also, the hinges are preferably living hinges.

A plurality of posts are provided in the lower edge for engaging within holes of a support when the blank is formed in to the tower.

In addition, there are a plurality of spaced apart tabs on an inner surface of the planar member for holding a reinforcing panel therein when the blank is formed into the tower.

Lastly, the upper edge of the blank extends substantially at a right angle to the side edges, and the lower edge includes at least one edge portion substantially perpendicular to the side edges and at least one other edge portion extending at an angle other than a right angle with relation to the side edges.

The above and other objects, features and advantages of the invention will become readily apparent from the following detailed description thereof which is to be read in connection with the accompanying drawings.

DETAILED DESCRIPTION

Figure 1:
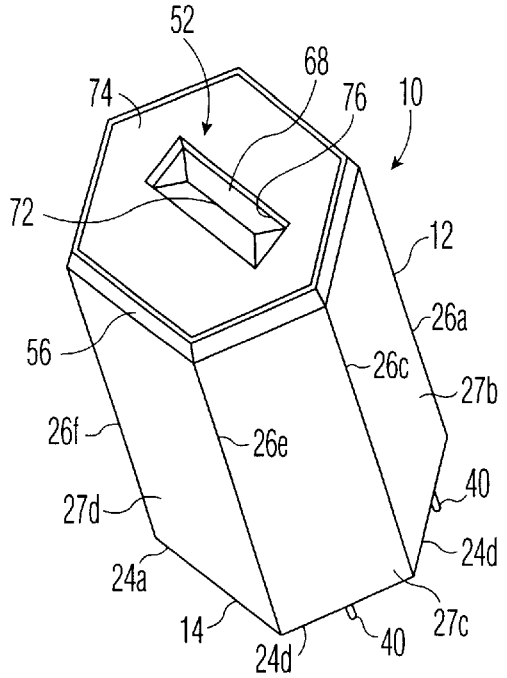
FIG. 1 is a top and right side perspective view of a jewelry rocket according to the present invention.
Figure 2:
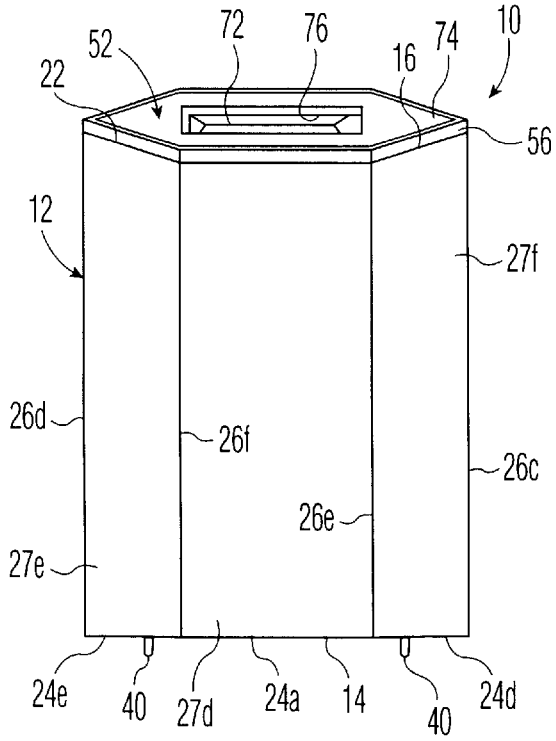
FIG. 2 is a front elevational view of the jewelry rocket of FIG. 1.

Referring to the drawings in detail, a jewelry rocket 10 according to the present invention includes a thin-walled, hollow tower 12 having a generally hexagonal cross-sectional configuration, although the present invention is not limited thereby and can have any other suitable configuration, such as circular, triangular, square, heart-shaped, oval, etc. As shown, tower 12 is angled forwardly from a lower edge 14 thereof at a first angle and has an upper edge 16 angled forwardly at a second, lesser angle, although the present invention is not limited to these angular relationships. For example, it is possible for tower 12 to stand vertically upright at a right angle to a support surface, and have an upper angled or non-angled edge.

Figure 11:
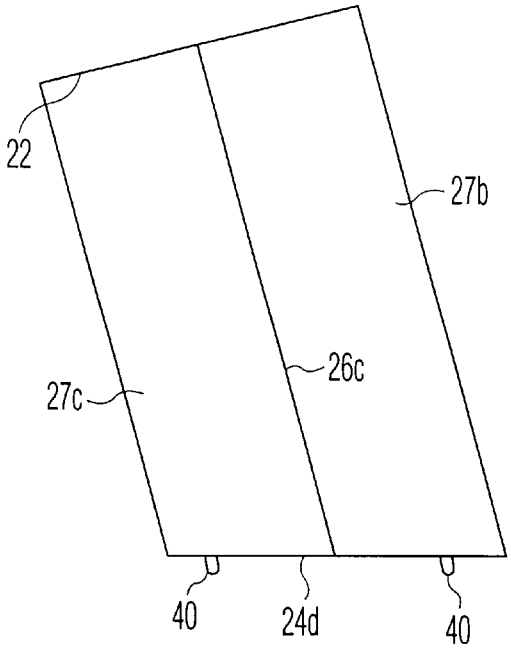
FIG. 11 is a side elevational view of the tower of FIG. 9.
Figure 12:
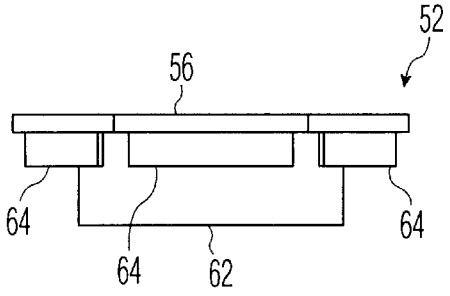
FIG. 12 is a side elevational view of the jewelry holder of the jewelry rocket of FIG. 1, mounted on the tower of FIG. 9.
Figure 13:
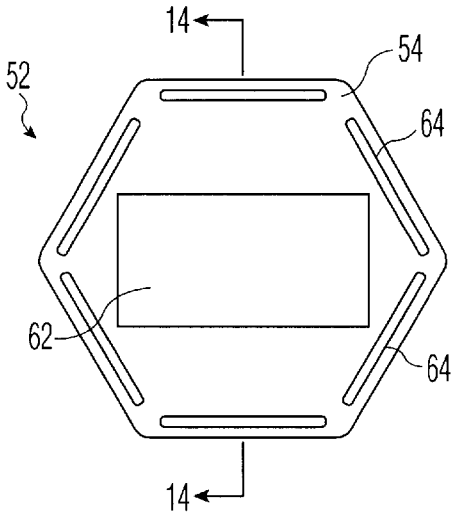
FIG. 13 is a bottom elevational view of the jewelry holder of FIG. 12.

In accordance with the present invention, tower 12 is made from a molded, rigid plastic planar blank 20, which is shown in FIGS. 5–8. Blank 20 includes a linear upper edge 22, and a lower edge 24 with a central edge portion 24*a* and end edge portions 24*b* and 24*c* which are parallel to upper linear edge 22, but spaced a greater distance away from upper linear edge 22 than central edge portion 24*a*. Lower edge 24 further includes linear angled edge portions 24*d* and 24*e* which connect central edge portion 24*a* to end edge portions 24*b* and 24*c*, respectively. Side edges 25*a* and 25*b* connect end edge portions 24*b* and 24*c* to upper linear edge 22, and are perpendicular thereto. When tower 12 is formed from blank 20, central edge portion 24*a*, end edge portions 24*b* and 24*c*, and angled edge portions 24*d* and 24*e* lie in a common plane which is horizontal to a support surface, thereby providing an angular inclination to tower 12, as best shown in FIG. 11.

Linear living hinges 26*a*–26*f* extend between upper edge 22 and lower edge 24. Each living hinge 26*a*–26*f* extends at a right angle to upper edge 22, with all living hinges 26*a*–26*f* being parallel to each other. Each living hinge 26*a*–26*f* is formed by a V-shaped cut-away portion of blank 20. Further, each living hinge 26*a*–26*f* is formed on the same side of blank 20. With this arrangement, blank 20 can be folded about living hinges 26*a*–26*f* to form tower 12.

As shown, living hinge 26*a* is formed at the junction of end edge portion 24*b* and angled edge portion 24*d*, while living hinge 26*b* is formed at the junction of end edge portion 24*c* and angled edge portion 24*e*. Living hinges 26*c* and 26*d* bisect angled edge portions 24*d* and 24*e*, respectively. Finally, living hinges 26*e* and 26*f* are formed at opposite ends of central edge portion 24*a*.

Accordingly, living hinges 26*a*–26*f* form panels 27*a*–27*g* which are separated by living hinges 26*a*, 26*c*, 26*e*, 26*f*, 26*d* and 26*b*, respectively.

In order to secure opposite side edges 25*a* and 25*b* together in the tower configuration, a plurality of pairs of locking members 30 are mounted in spaced relation from each other on the inner surface of blank 20 at side edge 25*a*, which is at panel 27*a*. Although four pairs of locking members 30 are shown, the present invention is not limited thereby. A plurality of single locking members 32 are mounted in spaced relation from each other on the inner surface of blank 20 at side edge 25*b*, which is at panel 27*g*, with the number of single locking members 32 being equal to the number of pairs of locking members 30. When blank 20 is folded into the tower configuration, with side edges 25*a* and 25*b* in abutting relation, each single locking member 32 friction fits between a respective pair of locking members 30 to hold blank 20 in the tower configuration.

Figure 3:
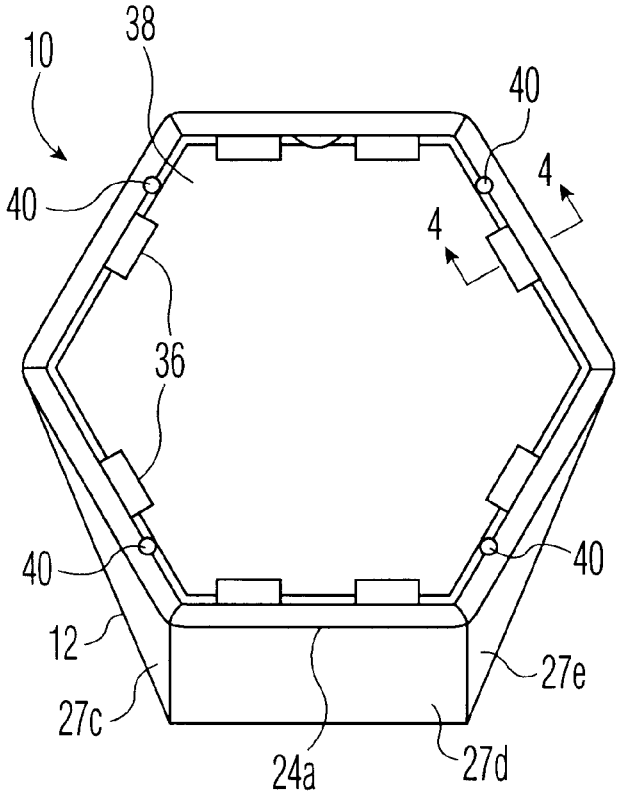
FIG. 3 is a bottom plan view of the jewelry rocket of FIG. 1.
Figure 4:
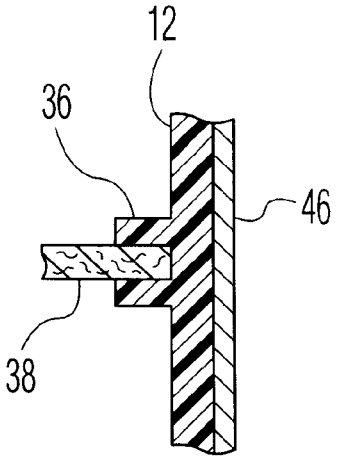
FIG. 4 is a cross-sectional view of the jewelry rocket of FIG. 3, taken along line 4—4 thereof.
Figure 5:
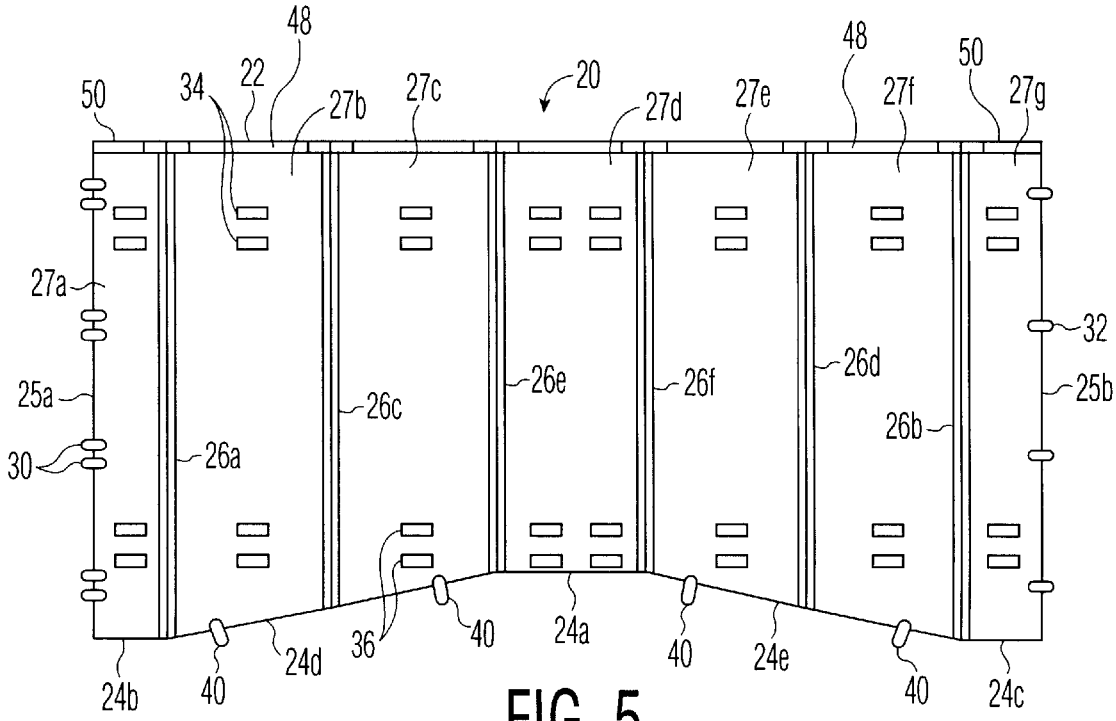
FIG. 5 is an inside plan view of a blank for forming the tower of the jewelry rocket of FIG. 1.
Figure 6:
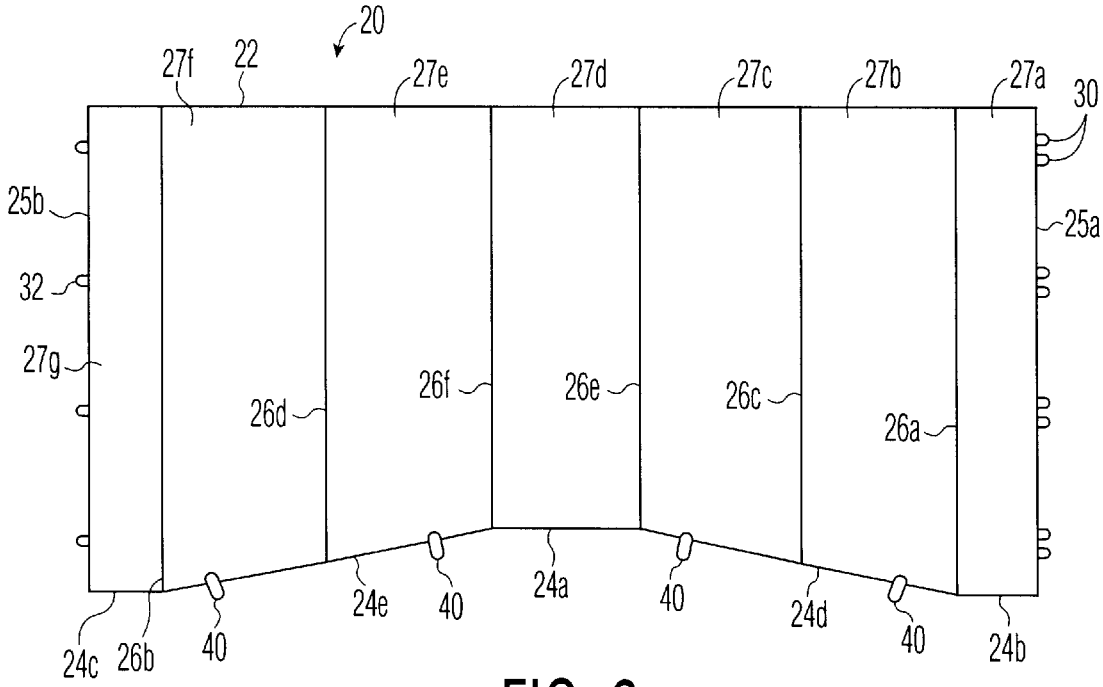
FIG. 6 is an outside plan view of the blank of FIG. 5.
Figure 7:
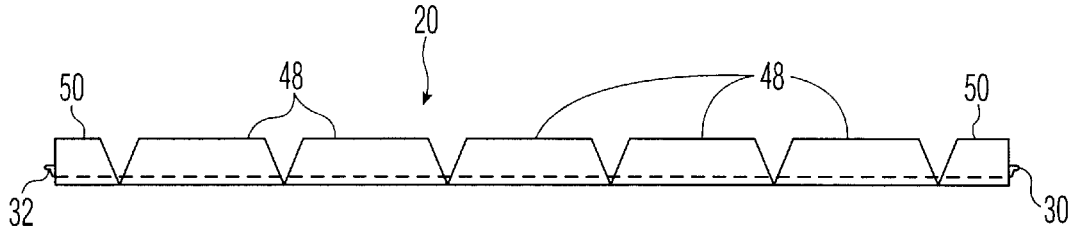
FIG. 7 is an elevational view of the blank of FIG. 5, viewed from the top thereof.
Figure 8:
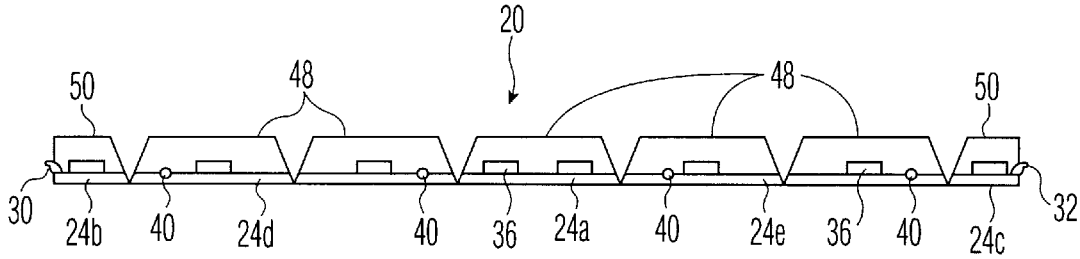
FIG. 8 is an elevational view of the blank of FIG. 5, viewed from the bottom thereof.

In order to add to the structural integrity of tower 12, blank 20 includes a plurality of parallel spaced apart pairs of tabs 34 near the upper end of each panel, with the pairs of tabs 34 being in transverse alignment with each other. Blank 20 further includes a plurality of parallel spaced apart pairs of tabs 36 near the lower end of each panel, with the pairs of tabs 36 also being in transverse alignment with each other. When blank 20 is folded into tower 12, a cardboard, plastic or other hexagonal reinforcing panel 38 is positioned within tower 12 and held between tabs 36, as shown in FIGS. 3 and 4. A similar cardboard, plastic or other hexagonal panel (not shown) is positioned within tower 12 and held between tabs 34. Reinforcing panel 38 also functions to retain the shape of tower 12.

Figure 9:
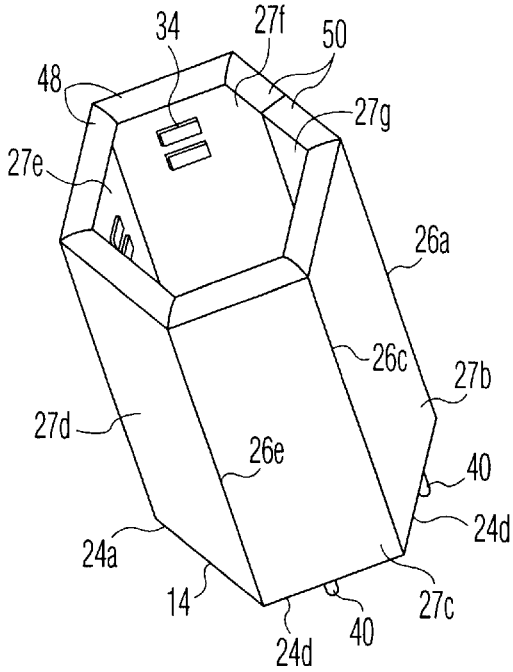
FIG. 9 is a top and right side perspective view of the tower of the jewelry rocket of FIG. 1, formed from the blank of FIG. 5.
Figure 10:
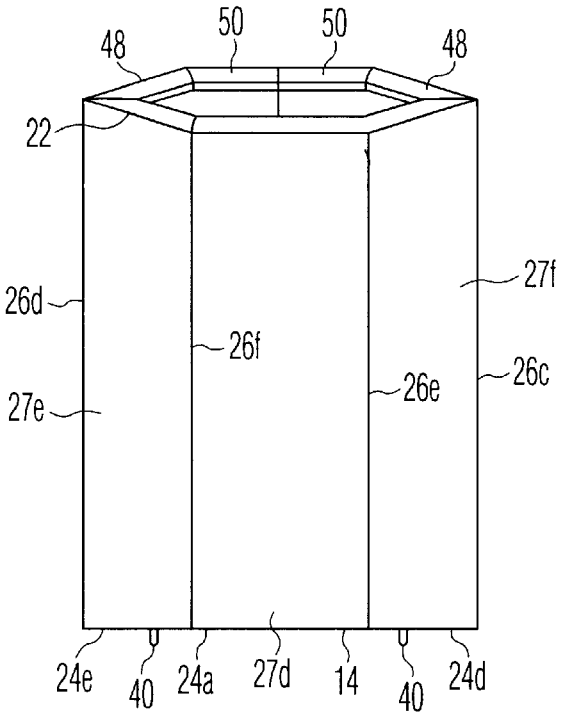
FIG. 10 is a front elevational view of the tower of FIG. 9.
Figure 15:
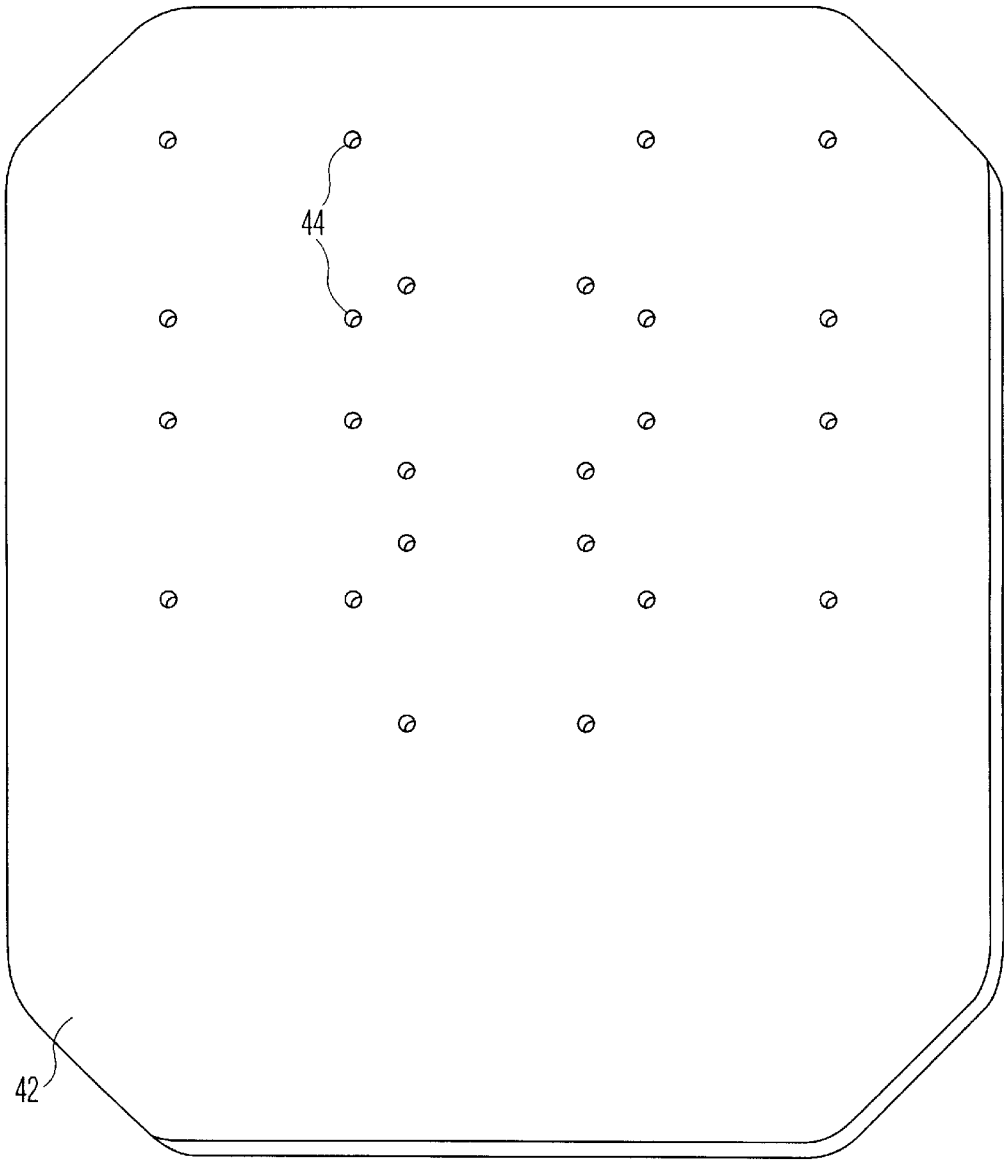
FIG. 15 is a top perspective view of a support for receiving and holding a plurality of jewelry rockets thereon.

In order to support tower 12 in the angular orientation of FIGS. 1, 9 and 11, small diameter support posts 40 are formed at lower angled edges 24*d* and 24*e*, and specifically, at panels 27*b*, 27*c*, 27*e* and 27*f*. Support posts 40 are angled such that, when tower 12 is formed, and lower edges 24*a*–24*e* lie in a common horizontal plane, support posts 40 extend at right angles to an upper surface of a support 42 (FIG. 15) having holes 44 therein to receive posts 40 and thereby stably retain tower 12 in this orientation. In this manner, a plurality of towers 12 can be releasably held on support 42.

Preferably, a leather wrapping 46, as shown in FIG. 4, is secured by adhesive or the like to the outer surface of tower 12 for aesthetic purposes and to hide the fold lines of living hinges 26*a*–26*f*. However, any other material can be used thereon, and the present invention is not limited to a leather material.

In addition, blank 20 includes upstanding trapezoidal shaped flanges 48 which extend at right angles from the inner surface of panels 27*b*–27*f* of blank 20 at upper edge 22 thereof. Also, half trapezoidal shaped flanges 50 extend at right angles from the inner surface of panels 27*a* and 27*g* of blank 20 at upper edge 22 thereof, such that, when blank 20 is folded into tower 12, flanges 50 abut each other and form together into the same shape and dimensions as a full trapezoidal shaped flange 48.

Jewelry rocket 10 further includes a rigid plastic jewelry holder 52 for holding an item of jewelry thereon, such as a ring. In the embodiment shown, jewelry holder 52 includes a hexagonal plastic molded plate 54 having outer dimensions which are the same as those of tower 12, such that when jewelry holder 52 seats on flanges 48 and 50, the outer surface of jewelry holder 52 forms a continuation of the outer surface of tower 12, although the present invention is not limited thereby.

An outer hexagonal flange 56 is formed at the periphery of plate 54 in order to form a hexagonal recess 58 at the upper surface thereof. Further, a rectangular opening 60 is formed in the center of plate 54 and a hollow, rectangular parallelepiped foam holder 62 is molded at the lower surface of plate 54 in surrounding relation to opening 60. Also, downwardly extending thin flanges 64 are formed at the lower surface of plate 54, spaced slightly in from each edge of the hexagonal periphery of plate 54 and in parallel relation thereto. When jewelry holder 52, and specifically, the lower surface of plate 54, sits on flanges 48 and 50, thin flanges 64 friction fit within flanges 48 and 50 in order to retain jewelry holder 52 on top of tower 12.

Jewelry holder 52 further includes a foam material 66 held in foam holder 62. A hexagonal fabric or leather covering 68 is provided in recess 58 in covering relation to opening 60. Both foam material 66 and covering 68 are die cut to form longitudinal slits 70 and 72 therein, respectively, so that a ring pushed through slits 70 and 72 is held by foam material 66. In addition, for decorative purposes, a fabric or leather hexagonal pad 74 is provided in recess 58 in covering relation to covering 68, and includes a rectangular opening 76 to permit easy access to slits 70 and 72.

Although jewelry holder 52 has been shown as including a foam material 66 with a die cut 70 therein for holding a ring, it will be appreciated that jewelry holder 52 can include any other suitable jewelry holding arrangement, such as ring posts similar to those in U.S. Pat. No. 5,649,625 to Ovadia, the opposing L-shaped projections disclosed in U.S. Pat. No. 5,758,765 to Ovadia, or the slider rod described in U.S. Pat. No. 5,775,484 to Ovadia.

Further, tower 12 can be oriented so that upper edge 22 supports tower 12 on a support surface, with lower edge 24 receiving the jewelry holder 52.

Figure 14:
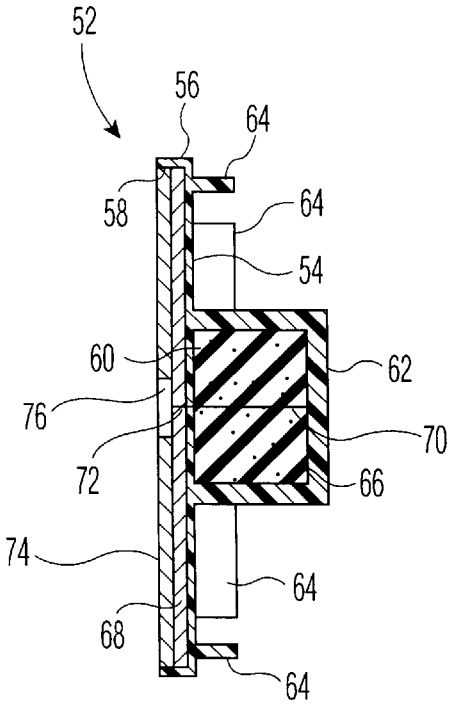
FIG. 14 is a cross-sectional view of the jewelry holder of FIG. 13, taken along line 14—14 thereof.
Figure 16:
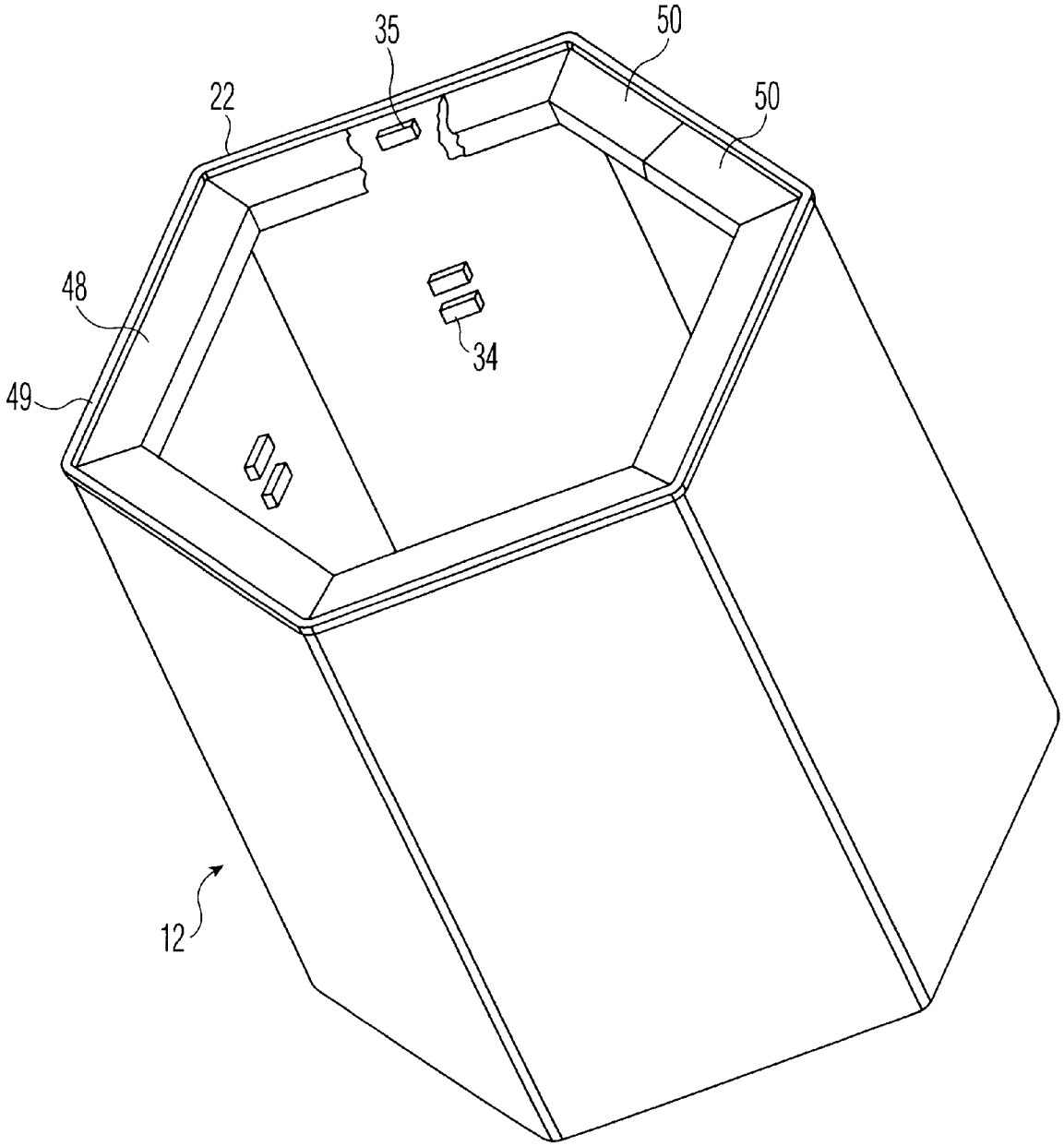
FIG. 16 is a perspective view of a tower according to another embodiment of the invention.
Figure 17:
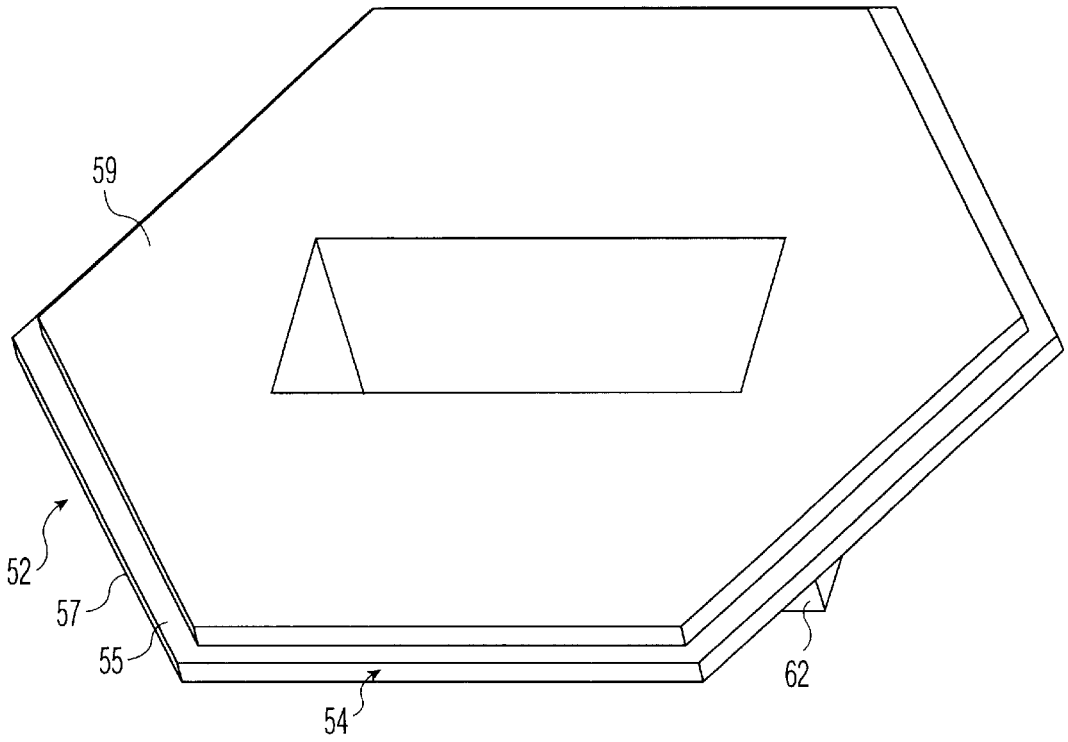
FIG. 17 is a perspective view of a modified jewelry holder.

As an alternative, flanges 48 and 50 can be provided slightly spaced from top edge 22, as shown in FIG. 16, whereby an outer peripheral lip 49 is formed above flanges 48 and 50. Further, single tabs 35 are provided on the inner surface of tower 12, spaced slightly beneath flanges 48 and 50. In such case, plate 54 of jewelry holder 52 can be formed with a peripheral cut-away shoulder 55 and a lower peripheral ledge 57, as shown in FIG. 17. Thus, ledge 57 is positioned within tower 12 and captured between flanges 48 and 50 and tabs 35. At the same time, the inner edges of flanges 48 and 50 seat on peripheral shoulder 55, such that the upper edges of flanges 48 and 50 and the upper surface 59 of plate 54 lie in a common plane to provide an aesthetic appearance. Foam material (not shown) is positioned in holder 62 and the entire upper surface is covered, as with covering 68 and pad 74 shown in FIG. 14.

Thus, jewelry rocket 10 can easily be constructed from molded blank 20, while still providing good structural integrity. Also, jewelry rocket 10 is lightweight and easily transportable in a disassembled form, while being easy and economical to use and manufacture.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A jewelry rocket comprising:

a thin walled, plastic tower made from a blank folded into a closed configuration, said tower including:

a plurality of panels of said blank having an inner surface, an outer surface, opposite side edges, a top edge and a bottom edge, a plurality of hinges of said blank hingedly connecting together adjacent side edges of said panels, all of said panels being pivoted about said hinges in a same folding direction to bring the inner surfaces of each two adjacent connected panels toward each other such that said panels are connected together in a closed perimetrical configuration which defines a hollow area therein, with opposite free side edges of two of said panels of said blank being in at least substantially abutting relation in said closed perimetrical configuration, fastening devices of said blank for securing said opposite side edges together to retain said tower in said closed perimetrical configuration, an upper edge defined by the top edges of said panels, and a lower edge defined by the bottom edges of said panels; and a jewelry holder including:

a securing assembly for seating on the upper edge, and a holding arrangement mounted to the securing assembly for holding a jewelry item such that the jewelry item is viewable on the jewelry holder.

2. A jewelry rocket according to claim 1, wherein said tower includes a plurality of posts in the lower edge for engaging within holes of a support.

3. A jewelry rocket according to claim 1, wherein said tower includes a plurality of spaced apart tabs on said inner surfaces of said panels for holding a reinforcing panel therein.

4. A jewelry rocket according to claim 1, wherein said lower edge of said tower is angled for causing said tower to extend from a support in an angular orientation other than a right angle.

5. A jewelry rocket according to claim 1, wherein said upper edge is angled forwardly relative to a support surface on which said jewelry rocket is mounted.

6. A jewelry rocket according to claim 1, wherein said fastening devices include at least one pair of locking members formed at one of said opposite side edges, and at least one other locking member formed at the other of said opposite side edges which friction fits within said at least one pair of locking members.

7. A jewelry rocket according to claim 1, further comprising a wrapping about said tower.

8. A jewelry rocket according to claim 1, wherein said tower includes inwardly directed flanges at said upper edge and tabs on an inner surface thereof spaced below said flanges, and said securing arrangement includes an outer edge that is captured between said flanges and said tabs.

9. A jewelry rocket according to claim 1, wherein said upper edge of said tower circumscribes a perimetrical opening in communication with said hollow area, and said securing assembly includes a plate seated on the upper edge and covering the opening thereat.

10. A jewelry rocket according to claim 9, wherein said tower includes inwardly directed flanges at said upper edge, and said securing assembly includes a plate that seats upon said upper edge of said tower and flanges extending downwardly from said plate for fitting within said inwardly directed flanges in order to retain said plate on said inwardly directed flanges.

11. A jewelry rocket according to claim 10, wherein said holding arrangement includes an opening in said plate, a holder extending down from said plate in surrounding relation to said opening, a foam material in said holder, said foam material including a first slit therein, and a covering on said plate in covering relation to said opening, said covering having a second slit in alignment with said first slit, such that a ring can be inserted through said first and second slits and be held by said foam material.

12. A jewelry rocket according to claim 1, wherein said panels are each substantially planar shaped.

13. A jewelry rocket comprising:

a thin walled, plastic tower made from a blank folded into a closed configuration, said tower having an upper edge and a lower edge, with an opening in the upper edge, said tower including inwardly directed flanges at said upper edge; and a jewelry holder including a plate for seating on the upper edge and covering the opening thereat, a holding arrangement for holding a jewelry item such that the jewelry item is viewable on the jewelry holder, and flanges extending downwardly from said plate for fitting within said inwardly directed flanges in order to retain said plate on said inwardly directed flanges.

14. A jewelry rocket comprising:

a thin walled, plastic tower made from a blank folded into a closed configuration, said tower having an upper edge and a lower edge, with an opening in the upper edge; and a jewelry holder including a plate for seating on the upper edge and covering the opening thereat, and a holding arrangement for holding a jewelry item such that the jewelry item is viewable on the jewelry holder, said holding arrangement including an opening in said plate, a holder extending down from said plate in surrounding relation to said opening, a foam material in said holder, said foam material including a first slit therein, and a covering on said plate in covering relation to said opening, said covering having a second slit in alignment with said first slit, such that a ring can be inserted through said first and second slits and be held by said foam material.

15. A jewelry rocket comprising:

a thin walled, plastic tower made from a blank folded into a closed configuration, said tower having an upper edge and a lower edge, with an opening in the upper edge, said tower including inwardly directed flanges at said upper edge and tabs on an inner surface thereof spaced below said flanges; and a jewelry holder including a plate for seating on the upper edge and covering the opening thereat, and a holding arrangement for holding a jewelry item such that the jewelry item is viewable on the jewelry holder, and said jewelry holder including an outer edge that is captured between said flanges and said tabs.

* * * * *